United States Patent [19]

Makino et al.

[11] Patent Number: 4,639,278

[45] Date of Patent: Jan. 27, 1987

[54] METHOD OF MANUFACTURING AN AMORPHOUS MAGNETIC ALLOY

[75] Inventors: Yoshimi Makino; Yoshitaka Ochiai; Satoru Uedaira; Kazuhide Hotai; Koichi Aso, all of Yokohama; Masatoshi Hayakawa, Chigasaki, all of Japan

[73] Assignee: Sony Corporation, Tokyo, Japan

[21] Appl. No.: 564,729

[22] Filed: Dec. 23, 1983

Related U.S. Application Data

[63] Continuation-in-part of Ser. No. 314,737, Oct. 23, 1981, abandoned.

[30] Foreign Application Priority Data

Oct. 31, 1980 [JP] Japan ..... 55-153985

[51] Int. Cl.[4] ..... C21D 1/04

[52] U.S. Cl. ..... 148/108; 148/121

[58] Field of Search ..... 148/103, 108, 121

[56] References Cited

U.S. PATENT DOCUMENTS

| | | | |
|---|---|---|---|
| 4,116,728 | 9/1978 | Becker et al. | 148/31.55 |
| 4,236,946 | 12/1980 | Aboaf et al. | 148/108 |
| 4,249,969 | 2/1981 | DeCristofaro et al. | 148/108 |
| 4,312,683 | 1/1982 | Sakakima et al. | 148/108 |
| 4,379,004 | 4/1983 | Makino et al. | 148/108 |

FOREIGN PATENT DOCUMENTS

| | | | |
|---|---|---|---|
| 56-44746 | 4/1981 | Japan | 148/108 |

*Primary Examiner*—John P. Sheehan

*Attorney, Agent, or Firm*—Hill, Van Santen, Steadman & Simpson

[57] ABSTRACT

A method of manufacturing an amorphous alloy involves thermally treating or annealing the amorphous alloy material at a temperature lower than the crystallization temperature thereof through rotation of the alloy material relative to a magnetic field at a velocity so as to meet the following relationship:

$$R\tau_O = 0.5n$$

where

R is the number of revolutions per minute, $\tau_O$ is an average time required to cause the amorphous alloy material to reach a thermal equilibrium state of induced magnetic anisotropy, and n is an integer of at least 1.

The amorphous alloy thus prepared possesses a high permeability and a high saturated magnetic flux so that it is suitable as a soft magnetic core material, such a magnetic heads.

7 Claims, 5 Drawing Figures

METHOD OF MANUFACTURING AN AMORPHOUS MAGNETIC ALLOY

CROSS REFERENCE TO THE RELATED APPLICATION

This is a Continuation in Part application of our copending application U.S. Ser. No. 314,737, filed Oct. 23, 1981 now abandoned.

BACKGROUND OF THE INVENTION

1. Field of the Invention

The present invention relates to a method of manufacturing an amorphous magnetic alloy and, more particularly, to a method of manufacturing an amorphous magnetic alloy having a high permeability and a high saturated magnetic flux, which is suitable as a soft magnetic core material for magnetic heads or the like.

2. Brief Description of the Prior Art

Amorphous alloys known to be employed as soft magnetic core materials are of the Fe type, the Co-Fe type, the Co-Fe-Ni type, and the Fe-Ni type. Those amorphous alloys are manufactured by the centrifugal quenching method, the single roll method or the double roll method. In instances where those amorphous alloys are employed for magnetic heads, a high permeability in a low frequency range is required. Those manufacturing methods as mentioned hereinabove, however, produce an internal stress $\sigma$ in the amorphous ribbon during the manufacturing steps and the internal stress, when associated with the magnetostriction $\lambda$, deteriorates the magnetic performance, particularly the permeability $\mu(\mu \propto 1/\lambda\sigma)$. It is well known that, in an instance where the amorphous alloy of the Fe type is employed, the internal stress produced during the manufacturing step can be reduced by means of the annealing in the magnetic field or in no magnetic field after the manufacture, whereby the permeability is improved. However, a deterioration of permeability with a striction that will be produced through the punching of the amorphous alloy ribbon into core forms after the annealing or through the etching step cannot be prevented to a satisfactory extent by conventional methods.

It was already found in Japanese Patent Early Publication No.80,303/1980 that the amorphous alloy of the Co-Fe type can permit a great improvement in permeability by the rapid quenching after maintenance at a temperature T higher than the Curie temperature Tc and lower than the crystallization temperature Tcry ($0.95 \times Tc \leqq T \leqq Tcry$). Recent commercialization of magnetic recording media in which magnetizable or magnetic metal particles or powder having a high coercive force are employed, however, requires the employment of an amorphous alloy possessing a high saturated magnetic flux Bs, for example, higher than about 8,000 Gauss in addition to a high permeability. To render the saturated magnetic flux of the amorphous alloy higher, it is necessary to increase the amount of a transition metal element such as Co, Fe, Ni or the like to be contained in the alloy; however, an increase in the amount of the transition metal element to be added thereto provides a general tendency to decrease the Curie temperature Tc and at the same time increase the crystallization temperature Tcry of the amorphous alloy. For example, where the total amounts of Co and Fe in the amorphous alloy of the Co-Fe-Si-B type exceeds 78 at %, the crystallization temperature Tcry is lowered than the Curie temperature Tc. This results in the fact that, in instances where the amount of the transition metal element is increased in order to highten the saturated magnetic flux and the amount of the transition metal element exceeds a particular limit, for example, 78 at % in the case of the Co-Fe-Si-B type amorphous alloy, it becomes impossible to apply a method of improving the permeability by quenching from a temperature higher than the Curie temperature as hereinabove set forth. Further, particularly the Co-Fe type alloy has a large induced magnetic anisotropy resulting from the Co component present in the alloy so that, even if the alloy having a high saturated magnetic flux would have been produced, it cannot be practically employed without any treatment because of its low permeability.

We have already proposed in our copending U.S. Pat. Application Ser. No.161,077 (U.S. Pat. No. 4,379,004) that the heat treatment or annealing is carried out at a temperature lower than the crystallization temperature while relatively rotating an amorphous alloy material in a static magnetic field or in a rotating magnetic field. This method permits a disappearance of the induced magnetic anisotropy in the amorphous alloy and provides a great improvement in the permeability. It is further to be noted that, as this method is not dependent upon the relation of the Curie temperature Tc with the crystallization temperature Tcry of the amorphous alloy, it can be applied to a wide range of amorphous alloys. This method, however, requires that the heat treatment or annealing be carried out at such a state that the velocity of varying a magnetic field is rendered greater than the average velocity at which the alloy atoms are transferred by means of heat so that a relatively large rotating velocity is required.

OBJECTS AND SUMMARY OF THE INVENTION

Therefore, an object of the present invention is to provide a method of manufacturing an amorphous alloy having a high permeability and a high saturated magnetic flux.

Another object of the present invention is to provide a method of manufacturing an amorphous alloy in which the induced magnetic anisotropy can be eliminated at a sufficiently low rotating velocity.

In accordance with one aspect of the present invention, there is provided a method of manufacturing an amorphous alloy, which comprises thermally treating or annealing an amorphous alloy material at a temperature lower than the crystallization temperature of the amorphous alloy material through rotation thereof relative to a static magnetic field or to a rotating magnetic field at a velocity so as to satisfy the following relationship:

$$R_{\tau 0}=0.5N$$

where

R is the number of revolutions per minute, $\tau_0$ is an average time required to cause the amorphous alloy material to reach a thermal equilibrium state of induced magnetic anisotropy, and n is an integer of at least 1.

In this case, it is required that the time units to be expressed for the symbols R and $\tau_0$ correspond to each other.

DETAILED DESCRIPTION OF THE PREFERRED EMBODIMENTS

Figure 1:
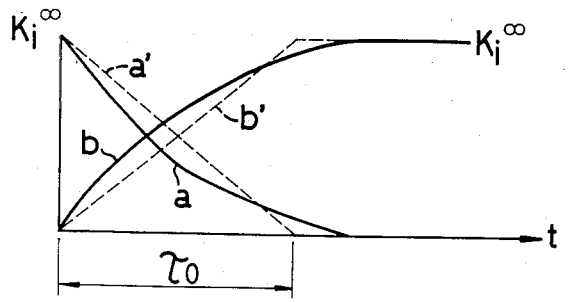
FIG. 1 is a graph illustrating a variation of the induced magnetic anisotropy with time where a magnetic field is applied in a direction parallel to the direction in which the induced magnetic anisotropy in the amorphous alloy is saturated or in a direction perpendicular to the direction to the amorphous alloy in which the induced magnetic anisotropy is saturated in one direction.

It is now to be noted that the method in accordance with the present invention is applicable to a wide range of amorphous alloys, particularly to the amorphous alloys which exhibit the effect produced by quenching in the magnetic field because it is not dependent upon the relation of the Curie temperature Tc with the crystallization temperature Tcry of the amorphous alloy. In particular, the method according to the present invention is extremely effective for amorphous alloys, for example, of the Co-Fe-Si-B type containing higher than approximately 78 at % of a transition metal element, having the crystallization temperature lower than the Curie temperature, to which conventional approaches are inapplicable, because it has a low permeability, although a high saturated magnetic flux.

The expression "relative rotation" and expressions in related terms as referred to herein are intended to include a two-dimensional rotation movement or a three-dimensional rotation movement resulting from a combination or synthesis of a plurality of two-dimensional rotation movements. It is also to be noted that, in instances where the induced magnetic anisotropy of the amorphous alloy in the planar direction alone is taken into account as in the case of, for example, an alloy in a thin form, such terms can include a variation in magnetic field which forms a pattern, when projected on a plane, as corresponding to such dimensional movements as referred to hereinabove, such as a variation in movement in which, for example, the magnetic vector moves in a manner as a conical pendulum. In these cases, the external magnetic field may be moved while the amorphous alloy material is fixed and vice versa. It is also possible to move both the external magnetic field and the alloy material.

Amorphous alloys can produce an induced magnetic anisotropy as those in crystal forms can and this phenomenon is remarkable particularly for the Co type amorphous alloys. This also can be assumed from the fact that an amorphous alloy such as $Fe_{4.7}Co_{75.3}Si_4B_{16}$ having little magnetostriction has a low permeability $\mu$ ($\mu \approx 1{,}000$) in a state where no further treatment is conducted on the amorphous alloy.

The appearance of the induced magnetic anisotropy in the amorphous magnetic alloy implies that portions of the short range order or of the pair order of atoms which can be magnetically induced are present although very small. The method in accordance with the present invention is to realize the irregular or amorphous state by eliminating the short range order or the pair order on the magnetically inducible portions through the annealing of the amorphous alloy material in a magnetic field in a direction relative to the external magnetic field. The conventional approach involves the realization of the irregular or amorphous state thereof by quenching.

In accordance with the present invention, the annealing or thermal treatment is carried out under the conditions satisfying a predetermined relation of the number of rotation relative to the magnetic field as set forth hereinabove.

It is now found that there is a particular relation between the rotating velocity relative to the magnetic field and the permeability under a constant temperature condition as described hereinabove. This relation enables an effective improvement in permeability even at a low rotating velocity.

The relation of the rotating velocity with the permeability will be described hereinbelow. Suppose that an amorphous alloy material is saturated with induced magnetic anisotropy in one direction and the magnetic field is applied thereto in a direction perpendicular to the direction in which the amorphous alloy is saturated with the induced magnetic anisotropy. As shown in FIG. 1, the induced magnetic anisotropy saturated to $K_i^{\infty}$, on the one hand, decreases to zero with time as indicated by the curved line a. The induced magnetic anisotropy in the direction at the right angle, on the other hand, increases with time to saturation to $K_i^{\infty}$, as indicated by the curved line b. It is to be noted that these curved lines a and b are close in shape to the curved lines a' and b', respectively, in the dashed lines. If a time required to cause the induced magnetic anisotropy to reach the equilibrium state is $\tau_0$, $\tau_0$ is a function between the composition of the amorphous alloy material and the temperature and it is regarded as a constant which can be primarily determined by these two variables.

The relative rotation velocity or number of rotation R between the amorphous alloy material and the magnetic field has the following relation to angular velocity $\omega$:

$$\omega = 2\pi R \tag{1}$$

For mathematical simplicity an approximation is employed for the processes as shown by the dashed lines in FIG. 1. $\tau_0$ is grow and/or decay time in the approximation. The sweeping angle $\phi_0$ within the grow and/or decay time $\tau_0$ is given as $$\phi_0 = \omega\tau_0 \tag{2}$$

Then, equations (1) and (2) become $$\phi_0 = 2\pi\tau_0 R \tag{2'}$$

Figure 2:
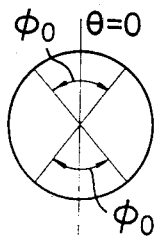
FIG. 2 is a schematic representation illustrating the sweeping angle $\phi_0$ of the magnetic field within the time $\tau_0$.

As shown in FIG. 2, the origin of the angular coordinate ($\theta = 0$) is put on the center of $\phi_0$ and $\phi_0$ is divided by n equal parts as $\Delta\phi = \phi_0/n$.

Then, if the induced magnetic anisotropy created in $\Delta\phi$ is $\Delta K_i^{\infty} = K_i/n$, the rectangular distribution model in which it is assumed that the induced magnetic anisotropy $\Delta K_i$ distributes uniformly in the sweeping angle $\phi_0$ can give a relation as $$\Delta K_i = \frac{\Delta\phi}{\phi_o} K_i^{\infty} \tag{3}$$

After these manipulations, the following formula can be given:

$$E(\theta) = -\Delta K_i \sum_{k=-\frac{n}{2}}^{k=+\frac{n}{2}} \cos^2(\theta + k\Delta\phi) \tag{4}$$

where k is the ordinal of a part from $\theta=0$.

Under the limit $n \rightarrow \infty$, that is, $\Delta\phi \rightarrow 0$ and $K\Delta\phi \rightarrow \phi$, equation (4) above becomes from equation (3) as $$E(\theta) = -\frac{K_i^{\infty}}{\phi_O} \int_{-\phi_O/2}^{+\phi_O/2} \cos^2(\theta + \phi)d\phi \tag{5}$$

$$= \frac{\sin\phi_O}{\phi_O} K_i^{\infty} \cos^2(\theta) + K_O$$

where $$K_o = \frac{K_i}{2\phi_o}(\phi_o - \sin\phi_o)$$

is a constant value.

Then, equations (1), (2) and (5) give the magnetic anisotropy energy $k_i$ in the rotating magnetic field as indicated by equation (6):

$$K_i = \frac{\sin\phi_o}{\phi_o} K_i^{\infty} = \frac{\sin 2\pi R\tau_o}{2\pi R\tau_o} K_i^{\infty} \tag{6}$$

The relation of the magnetic anisotropy energy $K_i$ and the permeability $\mu$ is given by $$\mu \propto 1/\sqrt{K_i} \tag{7}$$

where the magnetization is based on the domain wall displacement or by $$\mu \propto 1/K_i \tag{8}$$

where the magnetization is based on the rotation.

As it is considered that the magnetization up to a frequency of the order of the order of 100 KHz is based on the domain wall displacement as shown in the formula (7) above, the equations (6) and (7) become $$\mu \propto \sqrt{\frac{2\pi R\tau_O}{\sin 2\pi R\tau_O}} \tag{9}$$

In the formula (9), where $2\pi R_0$ is present in the third or fourth quadrant, $\mu$ becomes an imaginary number so that the relation having a physical significance becomes $$\mu \propto \sqrt{\frac{2\pi R\tau_O}{|\sin 2\pi R\tau_O|}} \tag{9'}$$

Figure 4:
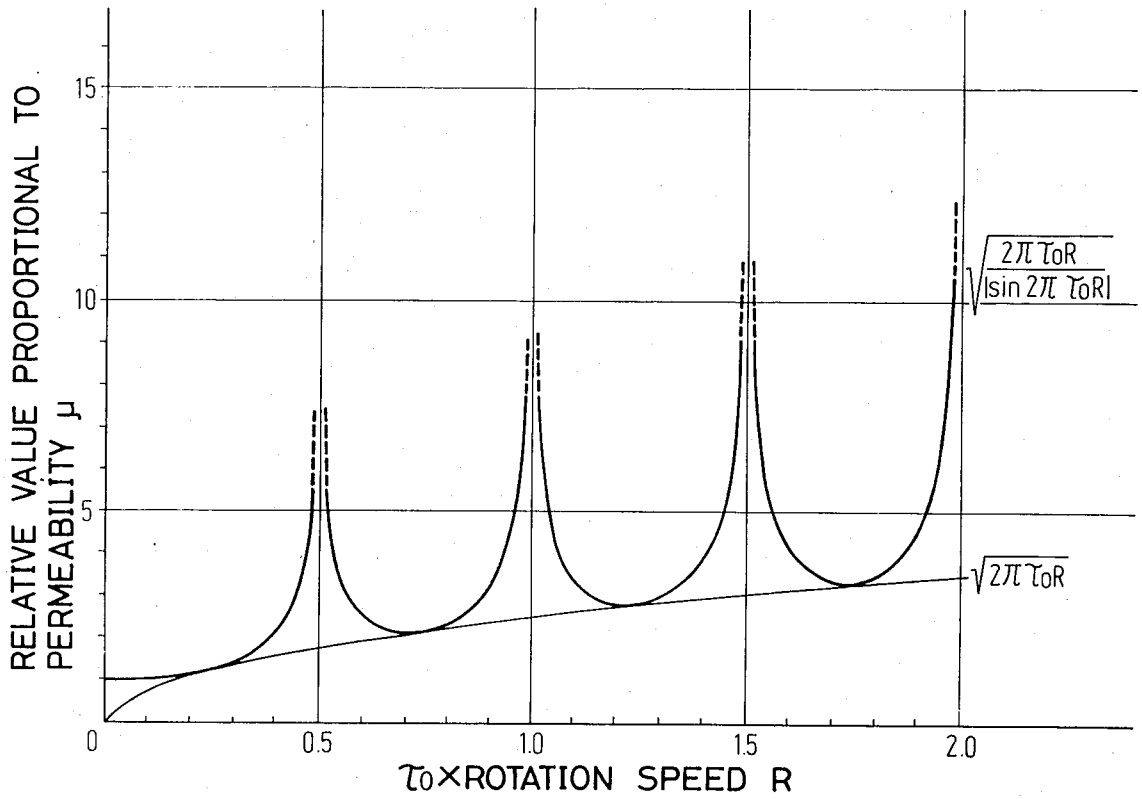
FIG. 4 is a graph illustrating the theoretical relation of the permeability $\mu$ with $\tau_0$x rotation speed R.

This relation is shown in FIG. 4.

It is apparent from the above results that the value of $\mu$ diverges infinitely as the following relation is satisfied:

$$R_{\tau 0} = 0.5n \tag{10}$$

where n is a natural number such as n=1, 2, 3, . . . . It is to be noted, however, that, as other factors work in fact, the value does not diverge infinitely and the maximum value is given where the relation as expressed in equation (10) is met.

Figure 3:
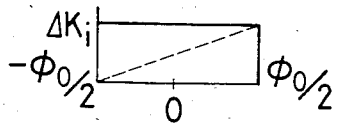
FIG. 3 is a schematic representation illustrating the distribution of the induced magnetic anisotropy $\Delta K_i$ within the angle $\phi_0$.

In the rectangular distribution model as illustrated hereinabove, it is assumed that the induced magnetic anisotropy created in the sweeping angle $\phi_0$ distributes uniformly. In fact, where the rotating field is scanned and passes away, the induced magnetic anisotropy even if occurred fades away so that the triangle distribution model as indicated by the dashed lines in FIG. 3 can give a closer approximation. In the model, the following formula is given $$\Delta K_i(\phi) = \Delta K_i(\tfrac{1}{2} + \phi/\phi_o) = \frac{\Delta\phi}{\phi_o} K_i^{\infty}(\tfrac{1}{2} + \phi/\phi_o) \tag{3'}$$

Where the rectangular distribution model as hereinabove mentioned is recalculated by utilizing the formula (3'), the following equation is obtained:

$$K_i = \frac{\left\{3 + \frac{1}{2}\left(\frac{1}{\tan 2\pi R\tau_O} - \frac{1}{2\pi R\tau_O}\right)\right\}}{4} \times \frac{\sin 2\pi R\tau_O}{2\pi R\tau_O} K_i^{\infty} \tag{6'}$$

In the above formula, the value $$\left\{3 + \frac{1}{2}\left(\frac{1}{\tan 2\pi R\tau_O} - \frac{1}{2\pi R\tau_O}\right)\right\}/4$$

is the effect of modification given by the triangle distribution model. The effect of modification is considered to work on the control of a peak value so that, in fact, a transition model between the rectangular and triangular distribution models will be realized.

It is apparent from the aforesaid description that, where the number of rotation during the heat treatment is defined as substantially satisfying the relation as shown in equation (10), it is possible to provide a relatively high permeability even where the rotating velocity is low. For example, the composition as indicated by $Fe_{4.7}Co_{75.3}Si_4B_{16}$ can give $\tau_0=0.067$ second at 370° C. Thus, it is found from the equation (10) that the number of rotation R be set as about 450 r.p.m. where n=1 or as 900 r.p.m. where n=2 or the like.

Where $R\tau_0=0.5n$, the permeability becomes maximum. Where $R\tau_0=an$ in which a is in the range from 0.4 to 0.6, an increase in the permeability becomes remarkable.

Although it is necessary that the temperature at which the heat treatment is carried out is lower than the crystallization temperature Tcry of the amorphous alloy, the temperature may be in the range within which each of the atoms can be thermally transferred. The range of temperature may vary with the composition of amorphous alloys, the strength of the external magnetic field, the time required for the thermal treatment or the like. In accordance with the present invention, where it may generally be higher than 200° C., the effect sought to be accomplished by the present invention is rendered remarkable. The higher the temperature for treatment, the shorter the treatment time. In particular, a temperature at which $\tau_0$ is in the order of minute is preferred from the relation with the treatment time.

The relaxation time $\tau_0$ can be determined as follows. First, an amorphous magnetic alloy sample which has induced magnetic anisotropy saturated along a first direction is prepared. The induced magnetic anisotropy of the sample is determined by measuring torque curve of the sample by a torque magnetometer at a room temperature. The torque curve depending on an angle $\theta$ has a maximum value which indicates $K_i^{\infty}$ value for the sample. Next, the sample is held at an annealing temperature Ta and to the sample is applied a magnetic field along a second direction perpendicular to the first direction for a certain period of time, to achieve a magnetic annealing. Then the sample is cooled to a room temperature and subjected to the torque measurement. After the magnetic annealing for the certain period of time, the anisotropy along the first direction decreases and the anisotropy along the second direction is induced. Thus the torque curve shifts with a certain angle with smaller value of $K_i$. The magnetic annealing at the annealing temperature for a certain additional period of time, and torque measurement for the annealed sample are repeated, thus a plurality of times of the magnetic annealing and torque measurement give a curve showing relation between annealing time and anisotropy along the first direction, as shown by the curve a in FIG. 1. Thus the relaxation time $\tau_0$ can be determined for the sample at the annealing temperature.

The relaxation time $\tau_0$ can also be determined by measuring change of permeability of a sample during magnetic annealing. The amorphous magnetic alloy sample is prepared in which uniaxial induced magnetic anisotropy is saturated along a first direction.

The permeability of the sample is measured at an annealing temperature under an application of pulse magnetic field along a second direction perpendicular to the first direction. The permeability is measured with a frequency, for example of 100 KHz during an interval where the magnetic field pulse is not applied to the sample. The measured result of the permeability has an initial value before the magnetic annealing, and as magnetic annealing continues, the permeability increases to a maximum value and then becomes a certain stable value. When the permeability shows the stable value, it indicates the magnetic anisotropy is fully induced along the second direction. Thus the integral value of the period of time of magnetic field pulse until the permeability becomes the stable value gives the relaxation time $\tau_0$.

According to the second method, the relaxation time $\tau_0$ shorter than a second can be easily determined.

EXAMPLE

Fe, Co, Si and B were weighed respectively to give $Fe_{4.7}Co_{75.3}Si_4B_{16}$ in atomic ratio and dissolved by a high frequency induction heating furnace to form a matrix alloy which in turn was quenched by a calender quenching apparatus as described and claimed in U.S. Pat. No. 4,212,344 to us to give an amorphous alloy in the form of a ribbon having a thickness of 20 to 40 microns and a width of 10 to 15 millimeters. X-ray diffraction analysis found the resulting alloy in the ribbon form amorphous. The differential thermal analysis gave its crystallization temperature Tcry=420° C.

Samples having the size of 12×12 mm cut from the alloy ribbon were subjected to thermal treatment or annealing at Ta≅370° C. and ta=10 minutes while rotating at a constant speed under the direct current magnetic field at H=2.4 KOe. The temperature of the sample was monitored with an alumel-chromel thermocouple. Immediately after the heat treatment was completed, the sample was quenched in the rotating field.

A ring-shaped sample having an outer diameter of 10 mm and an inner diameter of 6 mm was punched from the sample with a ultrasonic cutting machine and measured for its permeability $\mu$. The measurement of permeability $\mu$ was carried out with a Maxwell bridge under the magnetic field of 10 mOe. The relation of the number of rotation R (r.p.m.) with the permeability $\mu$ is shown in FIG. 5.

Figure 5:
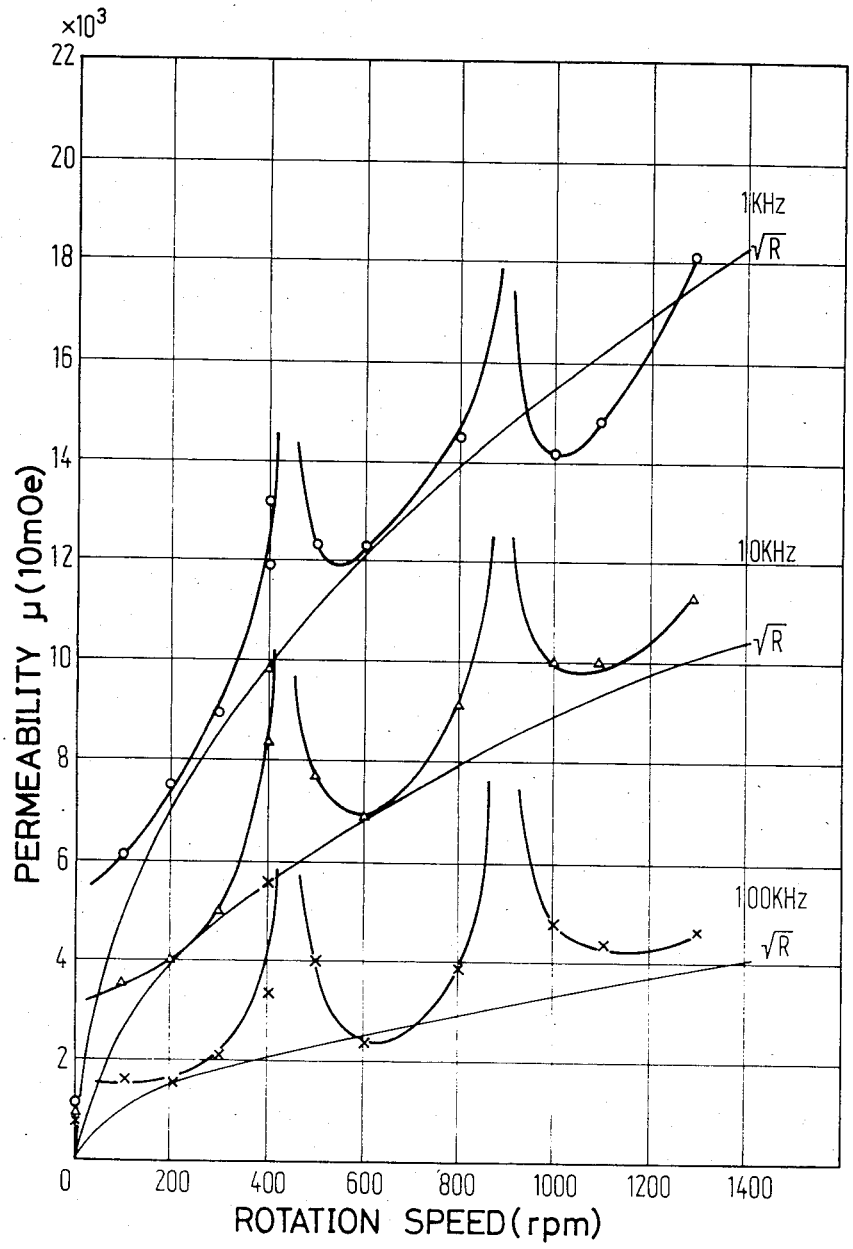
FIG. 5 is a graph illustrating the relation of the permeability $\mu$ with the number of rotation or rotation speed R in the amorphous alloy having the composition: $Fe_{4.7}Co_{75.3}Si_4B_{16}$.

As apparent from FIG. 5, the relation between the number of rotation or rotation speed R and the permeability $\mu$ is considerably close in shape to the theoretical curve as shown in FIG. 4 and it is shown that peaks are present at the numbers of rotation R being 450, 900 and 1,350 r.p.m., respectively. It is thus assumed that the permeability values at each of the peaks are within the scope ranging from about 30,000 to 40,000. This results in the fact that, in order to provide a permeability $\mu$ of higher than approximately 10,000 that is in the practically applicable range, the number of rotation or rotation speed R be selected nearby the position where the peaks are present.

What is claimed is:

1. A method of manufacturing an amorphous magnetic alloy comprising the steps of:

(A) preparing an amorphous magnetic alloy ribbon, and (B) annealing said ribbon at an elevated temperature less than the crystallization temperature of said alloy, said annealing being carried out in a magnetic field, said ribbon and said magnetic field being continuously rotated with respect to each other, the relative rotation being at a velocity substantially meeting the following relationship:

$$R_{\tau_0}=0.5n$$

where:

R is the number of revolutions per minute, $\tau_0$ is the average time required to cause the amorphous alloy material to reach a thermal equilibrium state of induced magnetic anisotropy, and n is an integer of at least 1.

2. The method according to claim 1 wherein the rotation of the amorphous alloy material is carried out while rotating the alloy material against a static magnetic field.

3. The method according to claim 1 wherein the relative rotation of the amorphous alloy material is carried out while the magnetic field is rotated against the stationary alloy material.

4. The method according to claim 1 wherein the relative rotation is carried out while the amorphous alloy material is rotated relative to the rotating magnetic field.

5. The method according to claim 1 wherein R is approximately 450 r.p.m. where n is 1.

6. The method according to claim 1 wherein R is r.p.m. where n is 2.

7. The method according to claim 1 wherein R is 1,350 r.p.m. where n is 3.

* * * * *